US006293668B1

(12) United States Patent
Kubby et al.

(10) Patent No.: US 6,293,668 B1
(45) Date of Patent: Sep. 25, 2001

(54) METHOD AND APPARATUS FOR TREATING RECORDING MEDIA TO ENHANCE PRINT QUALITY IN AN INK JET PRINTER

(75) Inventors: Joel A. Kubby; Lisa A. DeLouise; David A. Mantell, all of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/069,698

(22) Filed: Apr. 29, 1998

(51) Int. Cl.[7] ..... B41J 2/01; G03G 15/20
(52) U.S. Cl. ..... 347/101; 399/341
(58) Field of Search ..... 347/101, 3; 399/390, 399/341; 427/532, 444

(56) References Cited

U.S. PATENT DOCUMENTS

| | | | | |
|---|---|---|---|---|
| 4,081,213 | | 3/1978 | Bar-on et al. . | |
| 4,638,337 | | 1/1987 | Torpey et al. | 347/65 |
| 4,774,530 | | 9/1988 | Hawkins | 347/63 |
| 5,006,862 | * | 4/1991 | Adamic | 347/101 |
| 5,373,350 | * | 12/1994 | Taylor | 347/3 X |
| 5,380,769 | | 1/1995 | Titterington et al. | 523/161 |
| 5,428,384 | | 6/1995 | Richtsmeier et al. | 347/102 |
| 5,455,610 | | 10/1995 | Harrington | 347/43 |
| 5,457,486 | | 10/1995 | Malhotra et al. | 347/105 |

FOREIGN PATENT DOCUMENTS

| | | | | |
|---|---|---|---|---|
| 61-74876 | * | 4/1986 | (JP) | B41J/29/00 |
| 6-270397 | * | 9/1994 | (JP) | B41J/2/01 |

* cited by examiner

*Primary Examiner*—Fred L. Braun
(74) *Attorney, Agent, or Firm*—Betsy Harasek

(57) ABSTRACT

Plain paper is processed through a plain paper optimizer system prior to image formation on a recording surface. The optimizer system adds a fixing fluid during application of pressure and, optionally, heat to the paper surface. The surface contacted by the fixing fluid is enhanced, forming images of improved print quality. In one embodiment, plain paper is treated in an optimizer system, which has a heat and fuser assembly with silicone oil as the fixing fluid, and is transported into the print zone of an ink jet printer. Images printed on the treated surface demonstrate improvements in image quality manifested by reduction of both edge raggedness and intercolor bleeding.

3 Claims, 3 Drawing Sheets

METHOD AND APPARATUS FOR TREATING RECORDING MEDIA TO ENHANCE PRINT QUALITY IN AN INK JET PRINTER

BACKGROUND OF THE INVENTION AND MATERIAL DISCLOSURE STATEMENT

The present invention relates generally to printers which deposit marks on a recording medium to form images thereon and, more particularly, to a pre-print treatment of the recording media to enhance the print quality of the printed image.

Ink jet printers of the so-called "drop-on-demand" type have at least one printhead from which droplets of ink are directed towards a recording medium. Within the printhead, the ink is contained in a plurality of channels and energy pulses are applied to transducers to cause the droplets of ink to be expelled, as required, from nozzles at the ends of the channels.

In a thermal ink jet printer, the energy pulses are usually produced by resistors, which are individually addressable by current pulses to heat and vaporize ink in a channel or recess proximate to the nozzle. As a vapor bubble grows, ink bulges from the nozzles until the current pulse has ceased and the bubble begins to collapse. At that stage, the ink within the channel or recess retracts and separates from the bulging ink which forms a droplet moving in a direction away from the nozzles and towards the recording medium. The channel or recess is then re-filled by capillary action, which in turn draws ink from a supply cartridge. Operation of a thermal ink jet printer wherein the ink is expelled from channels is described in, for example, U.S. Pat. Nos. 4,638,337 and 4,774,530, which disclose a printer of the carriage type having a plurality of printheads, each with its own ink supply reservoir, mounted on a reciprocating carriage. The nozzles of each printhead are aligned perpendicular to the line of movement of the carriage and a swath of image information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

Many forms of recording media are known in the art. Special forms of coated paper are used to provide enhanced optical density and waterfastness. See, for example, U.S. Pat. No. 5,457,486 and the references summarized in columns 1–3. The various coated paper configurations add expense to the printing process, and the great majority of output prints are produced on non-coated plain paper. Because of the low cost of paper, it is widely used in spite of several problems with the quality of images printed thereon. Because the images are formed of aqueous based ink droplets falling onto an absorbent substrate, problems are created such as raggedness along the edges of the image; intercolor bleed (when printing more than one color), line "blooming", optical density and image permanence.

It has been appreciated that application of heat to plain paper, either before, during or after the printing, helps to alleviate some of the above-identified problems. U.S. Pat. No. 5,428,384 discloses use of a preheated drive roller to drive some moisture out of the paper and elevate the paper temperature to reduce paper cockle and curl. A post-heat blower dries the ink rapidly after being deposited on the recording media to help reduce smearing.

U.S. Ser. No. 08/523,322 filed on Aug. 30, 1995 and assigned to the same assignee as the present invention, utilizes a segmented flexible heater to pre-condition the record medium prior to entering the print zone. U.S. Pat. No. 5,380,769 discloses forming an ink image on a substrate; applying a release agent to the image and transferring the image to a recording medium at a fusing station.

Copending application U.S. Ser. No. 09/069,111 assigned to the same assignee as the present invention, filed concurrently herewith, with the named inventors Thomas W. Smith, Samuel Kaplan, Kathleen M. McGrane, and David J. Luca, the disclosure of which is totally incorporated herein by reference, disclose a process which comprises (a) applying to a substrate a fixing fluid which comprises a material selected from the group consisting of (1) block or graft copolymers of dialkylsiloxanes and polar, hydrophilic monomers capable of interacting with an ink colorant to cause the colorant to become complexed, laked, or mordanted, (2) organopolysiloxane copolymers having functional side groups capable of interacting with an ink colorant to cause the colorant to become complexed, laked, or mordanted, (3) perfluorinated polyalkoxy polymers, (4) perfluoroalkyl surfactants having thereon at least one group capable of interacting with an ink colorant to cause the colorant to become complexed, laked, or mordanted, and (5) mixtures thereof; (b) incorporating into an ink jet printing apparatus an ink composition which comprises water and a colorant which becomes complexed, laked, or mordanted upon contacting the fixing fluid; and (c) causing droplets of the ink composition to be ejected in an imagewise pattern onto the substrate.

Copending application U.S. Ser. No. 09/069,110 assigned to the same assignee as the present invention, filed concurrently herewith, with the named inventors Thomas W. Smith, John S. Facci, Michael J. Levy, and David J. Luca, the disclosure of which is totally incorporated herein by reference, discloses a fluid deposition apparatus comprising (a) a fluid supply, (b) a porous fluid distribution member in operative connection with the fluid supply, enabling wetting of the fluid distribution member with a fluid, and (c) a porous metering membrane situated on the fluid distribution member, whereby the metering membrane enables uniform metering of the fluid from the fluid distribution member onto a substrate.

SUMMARY OF THE INVENTION

It would be desirable to improve the print quality of a plain paper media by a simple pre-print treatment of the paper. The present invention provides a pre-print treatment which includes moving the paper, prior to recording thereon, through a plain paper optimizer system which includes at least pressure treatment of the paper coupled with application of a fixing fluid such as silicone oil to the paper surface. In a described embodiment, the optimizer system is a roller fuser system which fuses toner images transferred to plain paper. The plain paper emerges from the optimizer system with a uniform thin coating of the fixing fluid on the recording surface. The treated paper is subsequently printed on to form an output image, which has enhanced print quality with improvement in intercolor bleed and edge raggedness.

More particularly, the present invention relates to a method for printing images with improved print quality onto a treated plain paper, comprising the steps of:

- moving plain paper from a paper supply into a plain paper optimizer system,
- subjecting the paper to at least a pressure force while applying a fixing fluid onto the paper recording surface, resulting in a treated paper, moving the treated paper into a print station, applying a marking material in image configuration onto said treated paper recording surface and moving the paper into an output station.

DESCRIPTION OF THE INVENTION

Figure 1:
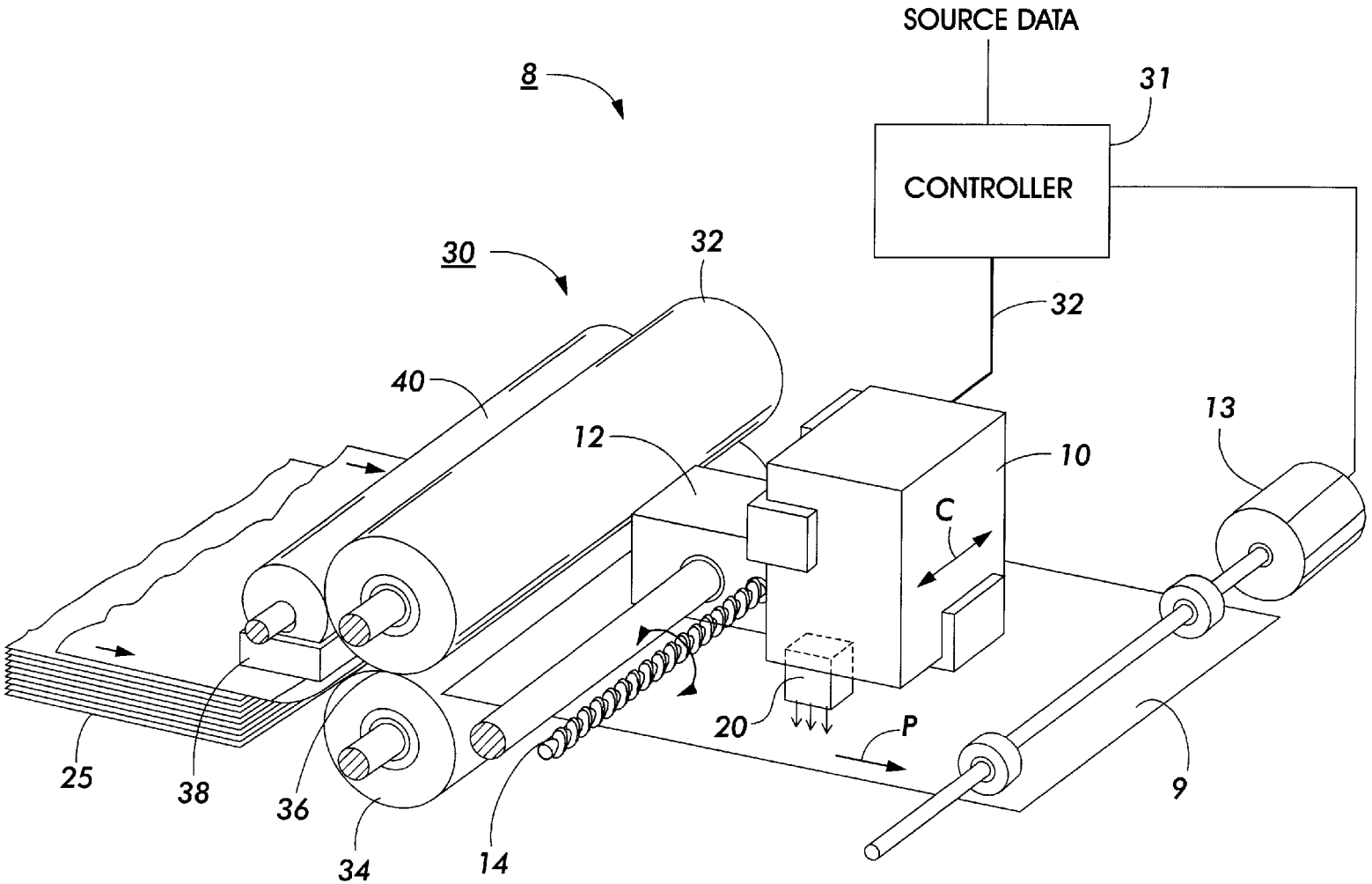
FIG. 1 is a perspective view showing the basic elements of a reciprocating carriage type of thermal ink jet printer incorporating the paper optmizer system of the present invention.

FIG. 1 shows a reciprocating carriage-type thermal ink jet printer 8 for creating color or monochrome images on a pre-treated sheet 9. Printer 8 is exemplary only. Other types of ink marking devices, such as piezoelectric ink jet, acoustic ink jet or a multifunction printer can be used. An ink cartridge 10, having a plurality of ink supplies therein, is preferably removably mounted on a carriage 12. This carriage 12 is adapted to move in a back-and-forth manner in direction C across sheet 9, which is moving in a process direction P. The sheet 9 is fed from a paper supply 25 by conventional feeding means along a paper path and in direction P by means of a stepper motor or other indexing motor 13, which is preferably adapted to cause the motion of sheet 9 in direction P in a stepwise fashion, holding the sheet 9 in a stationary position while the cartridge 10 moves across the sheet in direction C, and then indexing the sheet 9 in processing direction P between swaths of printing caused by the action of cartridge 10 being carried on carriage 12.

Carriage 12 is provided with one of various possible means for moving the cartridge 10 back and forth across sheet 9. As shown in FIG. 1, there is provided a rotatable lead screw 14 having threads thereon which interact with a structure on the carriage 12 so that, when lead screw 14 is caused to rotate by a motor (not shown, the interaction of the lead screw threads with the structure on carriage 12 will cause the carriage 12 and the cartridge 10 mounted thereon to move in direction C across the sheet 9. Preferably, in most embodiments of an ink jet printer for use with the present invention, the carriage should be controlled to allow substantially even back-and-forth motion of the cartridge 10 so that the printing operation can be carried out in both directions. This may be accomplished, for example, by operatively attaching lead screw 14 to a bi-directional motor, or providing oppositely-wound sets of lead screw threads on lead screw 14 so that, once carriage 12 is moved to one side of the sheet 9, the structure on carriage 12 will re-engage with the opposite-wound threads on lead screw 14 to be moved in the opposite direction while the lead screw 14 is rotated in the same rotational direction.

Attached to cartridge 10, as shown in FIG. 1, is a printhead 20, which is shown directed downward toward the sheet 9. Printhead 20 comprises one or more linear arrays of thermal ink jet ejectors, each ejector being operatively connected to a particular ink supply. Generally, the linear array of ejectors in printhead 20 extends in a direction parallel to process direction P, so that, when the cartridge 10 is caused to move in carriage direction C, the linear array will "sweep" across the sheet 9 for an appreciable length, thus creating print swaths. While the carriage is moving across the sheet 9, the various ejectors in the linear array are operated to emit controlled quantities of ink of preselected colors in an image-wise fashion, thus creating the desired image on the sheet. Typical resolution of the ink jet ejectors in printhead 20 may be from 50 spots per inch to 1200 spots per inch.

Also provided "upstream" of printhead 20 is a paper optimizing system which, in one embodiment, is a heat and pressure fuser system 30. System 30 includes a heated roll 32 and a roll 34 to which a loading force F is applied by conventional means at nip 36. The leading edge of sheet 9 enters into nip 36 and is moved in direction P in combination with the movement provided by motor 13. The fuser assembly further includes a sump 38 containing a fixing fluid and a meter roll 40 for transferring the fixing fluid from sump 38 to roll 32.

Operatively associated with the printer 8 is a controller 31. Controller 31 coordinates the "firing" of the various ejectors in the printhead 20 with the motion of cartridge 10 in carriage direction C, and with the process direction P of sheet 9, so that a desired image in accordance with the digital input image data is rendered in ink on the sheet 9. Image data in digital form is entered into controller 31, and controller 31 coordinates the position of the printhead 20 relative to sheet 9 to activate the various ejectors as needed, in a manner generally familiar to one skilled in the art of ink jet printing. Controller 31 will also control operation of motor 13, fuser 30 and paper supply 25. Further details of the operation of a printer corresponding to printer 8 are found in U.S. Pat. No. 5,455,610, whose contents are hereby incorporated by reference.

As sheet 9 proceeds through the fuser assembly 30, it acquires a uniform, thin layer of the fixing fluid. As the sheet advances into the print zone, ink is projected from printhead 20 creating an image consisting of a plurality of print swaths. When the print operation is complete, sheet 9 is deposited in an output station (not shown), typically an output tray.

It has been found that, because of the fuser pre-treatment, the quality of the output print has been improved. The image quality parameters of edge raggedness and color interbreed were evaluated and compared with print quality of untreated plain paper. The results are summarized below.

EDGE RAGGEDNESS IMPROVEMENT

Table I shows the results of the measurements performed on treated and untreated paper to verify improvements in edge raggedness. The fuser system 30 used was that contained in a commercially available Xerox 5100 Copier which uses Dow Corning 200 fluid as the fixing fluid. A fuser lamp heater at the measured power consumption of approximately 1400 watts (for fusing 11 inch paper). The average pressure in the nip is 0.5958 $N/mm^2$ (N=Newton), and the calculated average nip dwell time is approximately 29.67 ms. A uniform layer was formed on an 8½×11 inch recording sheet with a thickness of 1–5 micro-liters.

The print mechanism was a commercially available HP 850C ink jet printer.

TABLE I

| | | Top MFLEN | Bottom MFLEN |
|---|---|---|---|
| Experiment #1 | | | |
| Lab Exposure | untreated | 4.77 | 10.68 |
| | treated | 0.13 | 2.47 |
| | treated overnight | 1.13 | 3.70 |
| Experiment #2 | | | |
| Lab Exposure | untreated | 1.83 | 4.03 |
| | treated | 0.40 | 1.23 |
| 70% RH | untreated | 2.83 | 12.37 |
| Exposure | treated | 0.53 | 1.53 |

Edge raggedness is measured by a standardized process which reports a Mid Frequency Line Edge Noise (MFLEN) value. For a black line printed on a yellow background, an automated measuring device records a MFLEN value along the top and bottom of a printed line. An average of the top and bottom MFLEN values are usually reported, however, due to an apparent systematic jet directionality error in the particular HP 850C printhead used for these experiments, both numbers are reported.

The first test conducted involved preparing two treated papers. One was printed immediately after fusing and the second was allowed to set overnight and printed the following day. This experiment was done to differentiate the effects of heat and oil treatment to which the paper is exposed in a xerographic fuser subsystem. As described supra, it is well known that preheating the paper drives out moisture and improves intercolor bleed and edge raggedness. The data in Table I clearly demonstrates a dramatic MFLEN improvement of the treated papers to the untreated. A slight degradation is observed for the paper that sat overnight before printing which is consistent with a reduction in paper water content due to heating in the fuser. To further explore the effect of moisture, a second experiment was done in which two treated samples were prepared. One paper was allowed to sit overnight in a 70% RH environment with an untreated paper. An equivalent set was allowed to sit overnight in laboratory conditions. Print samples were produced the next day immediately after the papers were removed from the humidity environment. The results, reported in Table I, again show a dramatic improvement in edge raggedness for treated papers. There is no discernible effect of humidity on the treated papers, whereas for the untreated papers the effect of humidity is quite apparent.

INTERCOLOR BLEED REDUCTION

Table II shows the improvement in intercolor bleed when paper is pre-treated. The intercolor bleed value average expresses MFLEN values for the line edges when one color is printed next to the other. Paper samples were treated by running through the same 5100 fuser described above. The samples to be treated and untreated were placed in a humidity chamber and humidified to RH 70 in order to eliminate the effect of paper dryness and heat. The printer used is a multi-die, color printhead with 600 dpi resolution and ejecting a carbon-based ink. Three different intercolor bleeds were considered: black/color; primary color/primary color and primary color/secondary color. All these combinations were significantly improved by this pre-treatment process; for yellow/black, from 4.2 to 1.2; for cyan/yellow, from 23.6 to 15.1 and for green/yellow, from 28.1 to 17.05.

TABLE II

| Ink Combination | Untreated top | Untreated bottom | Fuser Treated top | Fuser Treated bottom |
|---|---|---|---|---|
| Yellow-Black: | | | | |
| 1 | 5.8 | 0 | 0.6 | 0 |
| 2 | 4.9 | 0 | 2.8 | 0 |
| 3 | 11 | 3.9 | 4 | 0 |
| average | 7.233333 | 1.3 | 2.466667 | 0 |
| average | 4.266667 | | 1.233333 | |
| Cyan-Yellow: | | | | |
| 1 | 18.6 | 33.4 | 15.3 | 12.2 |
| 2 | 22.9 | 21.3 | 21.5 | 16.1 |
| 3 | 27.2 | 18.4 | 9.3 | 16.3 |
| average | 22.9 | 24.36667 | 15.36667 | 14.86667 |
| average | 23.63333 | | 15.11667 | |
| Green-Yellow: | | | | |
| 1 | 37.2 | 32.3 | 21.5 | 20.5 |
| 2 | 23.2 | 23.1 | 12.9 | 22.1 |
| 3 | 34.1 | 19.2 | 7.4 | 17.9 |
| average | 31.5 | 24.86667 | 13.93333 | 20.16667 |
| average | 28.18333 | | 17.05 | |

While the embodiment of FIG. 1 used a paper optimizer system which included heat and pressure, it is believed that the primary enabler for obtaining improvements in edge raggedness and intercolor bleed reduction is the application of pressure to provide the thin fixing fluid coating. Therefore, as an alternate embodiment, roll 32 could be an unheated roll.

Figure 2:
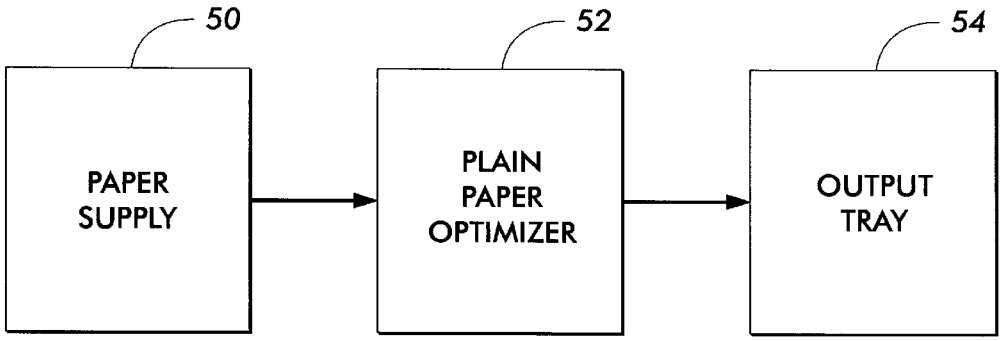
FIG. 2 is a schematic block diagram showing the basic concept of a system for treating plain paper to enhance the quality of prints formed on a recording surface.

From the above description, it will be appreciated that the paper can be pre-treated without immediately being moved into a print station. FIG. 2 shows a simplified block diagram showing paper fed from a paper supply 50 into plain paper optimizer 52 which can have the characteristics of the fuser 30 described supra. The paper acquires a treated surface and is collected at output tray 54. The treated paper can then be stored for subsequent use or shipped to other locations.

Figure 3:
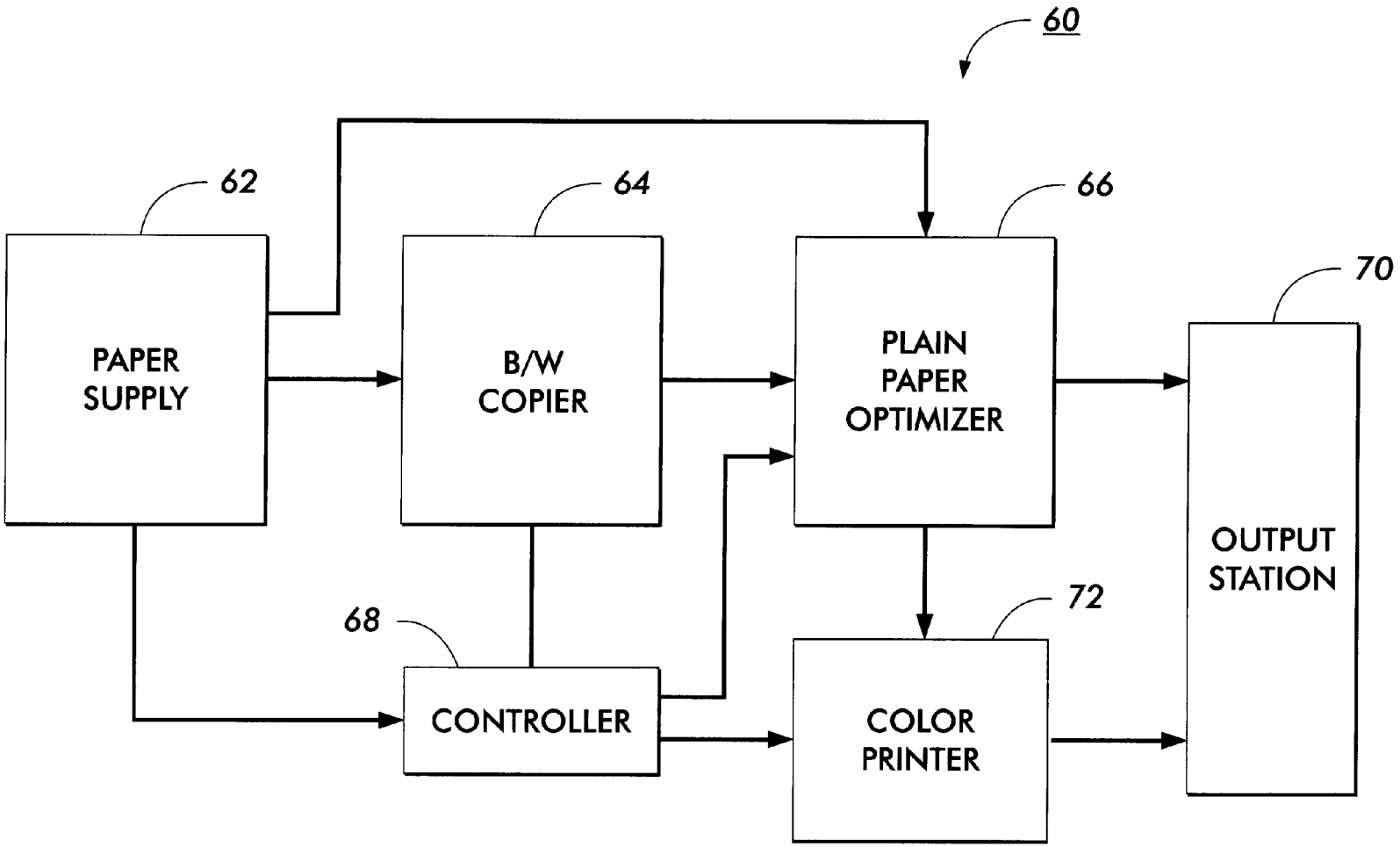
FIG. 3 is a block diagram of a hybrid copier/printer system which utilizes an optimizer system to fuse developed transfer images formed by the copier and uses the same optimizer system to pre-treat paper to be recorded on in an ink printer.

FIG. 3 shows a copy/print system 60 which enables either copying an image to produce a black and white copy or producing a color copy in a color marking device. A fuser, which can be incorporated into the copier or can be used as a stand alone device, is commonly used for either copying or a printing function. Referring to FIG. 3, system 60 includes paper from supply 62 fed into either a copier 64 or directly into a paper optimizing system 66 under controller of a controller 68. System 66, in a preferred embodiment, is the fuser system disclosed in FIG. 1. System 66 can be a stand alone unit, as shown, or can be incorporated into copier 64. Copier 64 has the conventional xerographic stations including an optical imaging station for forming an image on a photoreceptor, a station for developing the image and a station for transferring the image to a sheet of paper from supply 62. An exemplary copier is disclosed in U.S. Pat. No. 4,081,213, whose contents are hereby incorporated by reference. If system 60 is being used to produce black and white copies, a process sheet with the developed image transferred to a surface, is moved into system 66, where heat and pressure are applied simultaneously with application of a fixing fluid as described supra. The sheet bearing the fused image is deposited at an output station 70. If system 60 is being used to produce a color print, a sheet from supply 62 is moved directly into system 66 wherein the sheets recording surface is treated and then moved into the color printer marking station 72. Color images are formed on the treated surface, and the color print is deposited in the output station.

While specific characteristics have been provided for a heat and pressure system, it will be appreciated that the requirements for treating paper to improve the image quality may differ from the characteristics of the fuser used as the paper optimizer in the above embodiment. For example, a different pressure and/or heating range may be preferred for certain systems.

While the embodiment disclosed herein is preferred, it will be appreciated from this teaching that various alternative, modifications, variations or improvements therein may be made by those skilled in the art, which are intended to be encompassed by the following claims:

What is claimed is:

1. A method for printing images with improved print quality onto a treated plain paper, comprising the steps of:

moving plain paper from a paper supply into a plain paper optimizer system, subjecting the paper to at least a pressure force while applying a fixing fluid onto the paper recording surface, resulting in a treated paper, moving the treated paper into a print station, applying a marking material in image configuration onto said treated paper recording surface, moving the paper into an output station, and applying heat to said paper during the step of subjecting the paper to pressure.

2. An ink jet printer comprising:

a paper supply, a plain paper optimizer station, means for moving a sheet of plain paper from said paper supply into said optimizer station, means for applying at least a pressure force at said optimizer station to said paper while applying a fixing fluid to a recording surface of the paper to form a treated sheet, a printer for placing marks on said treated sheet in an image configuration, means for moving the treated sheet into a marking station of said printer and forming an image thereon, means for moving the sheet from said printer marking station to an output station, and means for applying heat to said paper simultaneously with application of said pressure force.

3. A recording apparatus for forming images on a plain paper recording medium, including:

a paper supply, a black and white electrophotographic reproduction machine including an optical station for forming a latent image on a photosensitive image member, means for developing said latent image, means for transferring said developed image to a sheet of paper fed from said paper supply, a color inkjet printer, control means for selectively moving a sheet of paper from said paper supply to either said optical station of said reproduction machine or to a fuser station, said fuser station comprising means for applying at least a pressure force to said sheet of paper while applying a fixing fluid to a recording surface of the sheet of paper, said control means further selectively moving a treated sheet with a developed fixed image to an output station or a fused sheet without images into said color input printer to form a color image on said treated sheet and means for moving the color print into said output station.

* * * * *